US008205682B2

(12) United States Patent
Guenther

(10) Patent No.: US 8,205,682 B2
(45) Date of Patent: Jun. 26, 2012

(54) ROTARY SWITCH

(75) Inventor: Benedikt Guenther, Cologne (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/639,818

(22) Filed: Dec. 16, 2009

(65) Prior Publication Data

US 2010/0218965 A1 Sep. 2, 2010

(30) Foreign Application Priority Data

Dec. 17, 2008 (DE) ..... 10 2008 054 786

(51) Int. Cl.
*E02D 7/14* (2006.01)

(52) U.S. Cl. ..... 173/48; 173/104; 173/109

(58) Field of Classification Search ..... 173/48, 173/104, 109, 201
See application file for complete search history.

(56) References Cited

U.S. PATENT DOCUMENTS

| | | | | |
|---|---|---|---|---|
| 4,236,588 | A * | 12/1980 | Moldan et al. | 173/48 |
| 4,763,733 | A * | 8/1988 | Neumaier | 173/48 |
| 5,456,324 | A * | 10/1995 | Takagi et al. | 173/48 |
| 6,035,945 | A * | 3/2000 | Ichijyou et al. | 173/48 |
| 7,264,065 | B2 * | 9/2007 | Simm et al. | 173/48 |
| 2007/0102174 | A1 * | 5/2007 | Duesselberg et al. | 173/48 |

FOREIGN PATENT DOCUMENTS

EP 1 632 314 A2 3/2006

* cited by examiner

*Primary Examiner* — Sameh H. Tawfik
*Assistant Examiner* — Nathaniel Chukwurah
(74) *Attorney, Agent, or Firm* — Crowell & Moring LLP

(57) ABSTRACT

A rotary switch for shifting a switch element is disclosed. The switch includes a twist handle, a torsion spring, a rotatable actuating element and a common axis. The twist handle, the torsion spring and the rotatable actuating element are supported so as to be rotatable about the common axis. The twist handle and the rotatable actuating element are coupled with each other by the torsion spring in such a manner that a twisting of the twist handle relative to the rotatable actuating element twists the torsion spring. An eccentric is provided on the rotatable actuating element in order to convert a rotary motion of the rotatable actuating element into a shifting motion of the switch element.

19 Claims, 3 Drawing Sheets

ROTARY SWITCH

This application claims the priority of German Patent Document No. 10 2008 054 786.7-34, filed Dec. 17, 2008, the disclosure of which is expressly incorporated by reference herein.

BACKGROUND AND SUMMARY OF THE INVENTION

The present invention relates to a rotary switch and a hand tool machine comprising such a rotary switch, in particular a rotary switch for selecting between two modes of the hand tool machine, e.g., a percussion mode and a drill percussion mode, with a combination hammer.

A rotary switch for actuating an axially slidable switch element of a hand tool machine has been known from European Patent Document No. EP 1 632 314 A2. An eccentrically arranged parable-shaped lug is clamped to a twist handle. A spiral spring is hinged to a pin located outside the twist handle. Two spring legs of the spiral spring enclose the parable-shaped lug. In addition, the two spring legs clamp a projection in place on the axially slidable switch element. When the twist handle is being turned, respectively one of the spring legs is unhinged by the lug against a spring bias while the lug detaches from the other spring leg. The other spring leg exerts a force on the projection until the axially shiftable switch element moves in the lateral direction and the other spring leg abuts again against the lug.

Indeed, with the rotary switch in accordance with EP 1 632 314 A2, it is possible to implement a synchronization of the position of the axially shiftable switch element with the position of the rotary switch, independently of the direction of rotation; however, this involves great effort in assembling the rotary switch because the switch cannot be attached in one piece to the tool machine. Furthermore, the two spring legs must be clamped on when the spiral spring is being mounted.

The object is to provide a rotary switch featuring a simplified assembly option.

The inventive rotary switch for shifting a switch element comprises a twist handle, a torsion spring, a rotatable actuating element and a common axis. The twist handle, the torsion spring and the rotatable actuating element are supported so as to be rotatable about the common axis. The twist handle and the rotatable actuating element are coupled via the torsion spring in such a manner that a relative twisting of the twist handle with respect to the rotatable actuating element twists the torsion spring. An eccentric is provided on the rotatable actuating element in order to convert a rotary motion of the rotatable actuating element into a shifting motion of the switch element.

The rotatable actuating element follows the rotating motion of the twist handle to the extent that the actuating element is not hindered from doing so by the switch element that is coupled to the eccentric. Then the rotatable actuating element and the twist handle again assume a synchronous position. The relative twisting is understood to refer to one of the synchronous positions of the twist handle relative to the actuating element. In the synchronous position, the torsion spring is preferably again in an inoperative position with minimal or no tension. This is possible because the torsion spring can also rotate about the axis of rotation. A mechanical load applied to the rotary switch in a synchronous position may thus be advantageously low.

The common arrangement of the elements on one axis allows a prefabrication of the rotary switch that can then be fastened as one component to a tool machine. In particular, the clamping legs of a spring need not be fastened to a spring of a tool machine.

Considering a further development, the twist handle can be twisted relative to the rotatable actuating element in a negative direction of rotation and relative to the axis of rotation in the positive direction of rotation. The twist handle and the rotatable actuating element, respectively, comprise an abutment that faces in the positive direction of rotation relative to the axis of rotation, and an abutment that faces in the negative direction of rotation relative to the axis of rotation. The torsion spring comprises two engagement elements. The engagement elements are arranged with respect to the abutments in such a manner that, as a result of relative twisting, one engagement element—the element being subjected to a force—couples with one of the abutments of the twist handle, and that the other engagement element—the element being subjected to a force—couples with one of the abutments of the rotatable actuating element, whereby the abutment of the twist handle—the abutment being subjected to a force—and the abutment of the actuating element—the abutment being subjected to a force—are facing in opposing directions of rotation. Consequently, the abutments bias the torsion spring when the actuating element cannot follow a direction of rotation of the twist handle in a synchronous manner. In an inoperative position, the torsion spring may also be biased in both directions. As a result of this, the switching force may be increased.

One embodiment provides that one of the engagement elements couples only with the abutments of the twist handle and the other engagement element couples only with the abutments of the actuating element, or that one of the engagement elements couples only with abutments that face in the positive direction of rotation and the other engagement element couples only with abutments that face in the negative direction of rotation.

The engagement elements may have a radial extension that extends from the axis of rotation over at least the first distance and the second distance. The abutments of the twist handle may be arranged at a first distance from the axis of rotation, the abutments of the rotatable actuating element may be arranged at a second distance from the axis of rotation, whereby the first distance and the second distance are different from each other.

Considering a further embodiment, the engagement elements delimit a continuous sector of a circle relative to the axis of rotation, whereby all the abutments are arranged within the sector. In a synchronous position, respectively one of the abutments of the twist handle and one of the abutments of the actuating element abut against one of the engagement elements and the other abutment of the twist handle and the other abutment of the actuating element abut against the other engagement element.

Another development is characterized by a rotatable bearing that has a hollow hub and a pin that is inserted into the hollow hub so as to be rotatable. Either the hollow hub may be configured as a part of the twist handle and the pin as part of the rotatable actuating element, or the hollow hub may be configured as part of the rotatable actuating element and the pin as part of the twist handle. The twist handle and/or the rotatable actuating element may be fabricated in one piece as injection-molded parts. As a result of this, a simple and compact design of the rotary switch can be achieved.

Considering a tool machine having at least two different drive modes, an axially shiftable clutch may be provided for switching between the drive modes. A selector switch is configured as the inventive rotary switch, whereby the eccentric of the switch is coupled with the clutch. The switching paths or the distance of the eccentric from the axis may be configured in such a manner that—in the desired switching positions—a connecting line between the eccentric and the axis is parallel to the axial switching path. Consequently, the selector switch and the spring may be disengaged due to forces acting in axial direction.

In a further development of the tool machine, the eccentric is coupled with the clutch by means of a sleeve-shaped switching rod assembly. The tool machine may have a cylinder-shaped drive arrangement, whereby the sleeve-shaped switching rod assembly circumscribes the drive arrangement. The sleeve-shaped switching rod assembly ensures high mechanical stability. The switching rod assembly may be supported so as to be rotatable about an axis of symmetry relative to the clutch. The switching rod assembly and the clutch may be configured so as to come into ring-shaped engagement with each other for axially shifting the clutch by means of the switching rod assembly. Consequently, the switching rod assembly can actuate the clutch, independently of the rotary position of the clutch. At the same time, the ring-shaped engagement ensures a uniform application of force in order to prevent warping.

The tool machine may comprise a percussion drive and a rotary drive for a tool, whereby the clutch selectively couples the percussion drive and/or the rotary drive with the tool. In particular, the tool machine may be a hand tool machine, a combination hammer.

The description hereinafter explains the invention with reference to exemplary embodiments and the figures.

DETAILED DESCRIPTION OF THE DRAWINGS

Elements that are the same, or have the same functions, are indicated by the same reference signs in the figures, unless stated otherwise.

Figure 1:
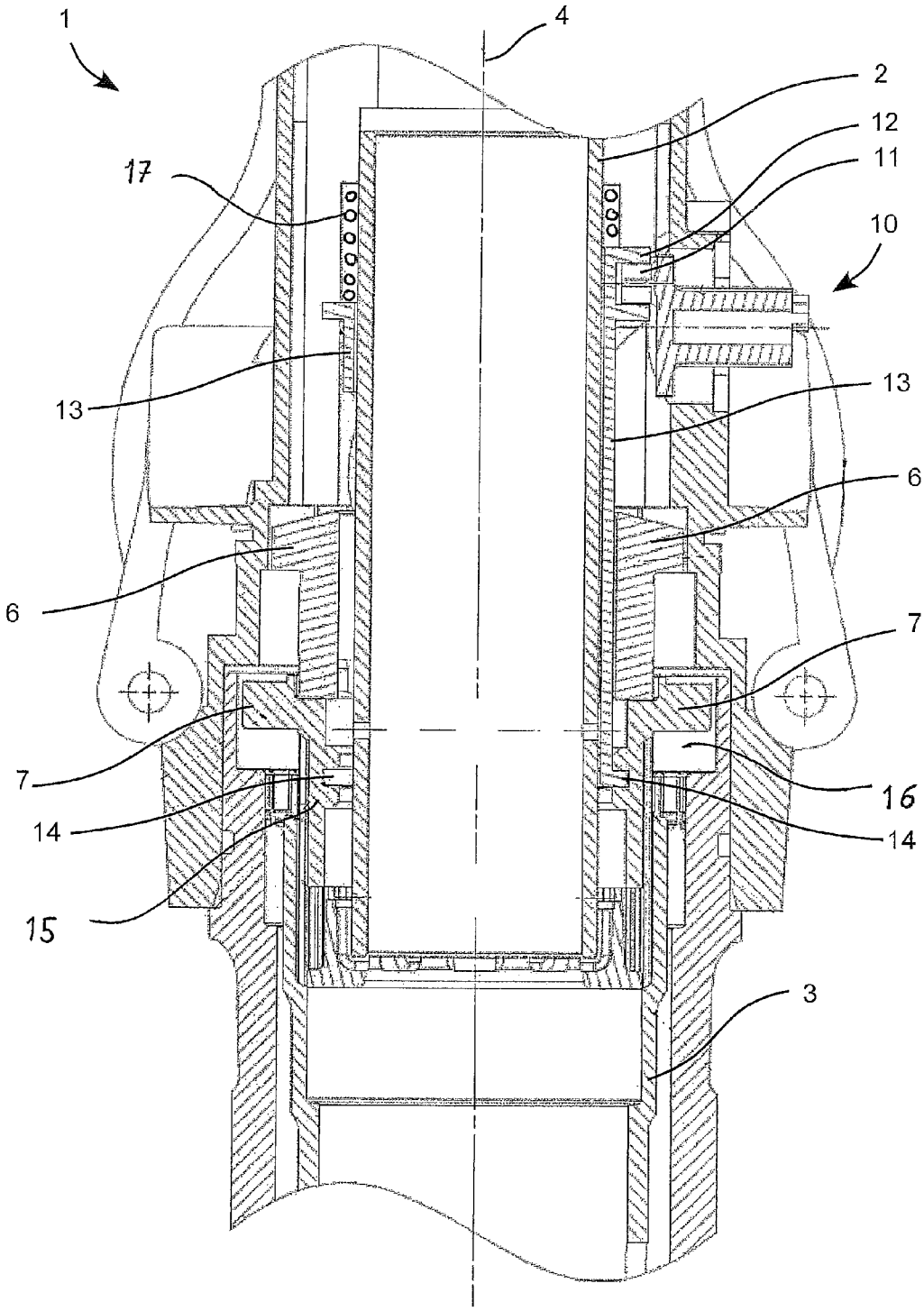
FIG. 1 is a partial section of a combination hammer.
Figure 2:
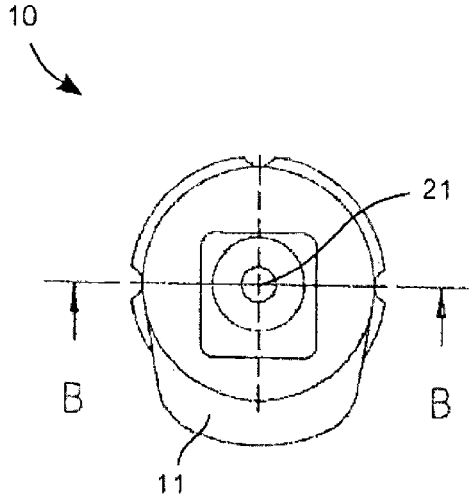
FIG. 2 is a plan view of the selector switch.
Figure 3:
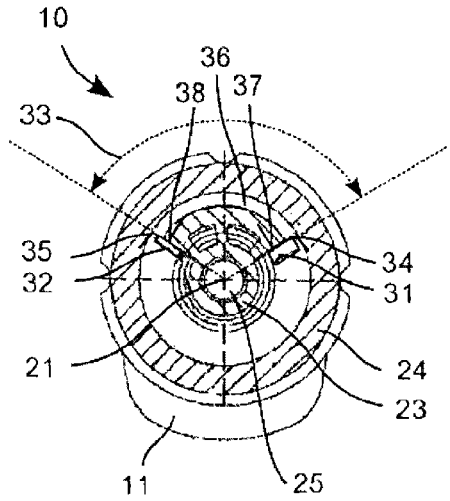
FIG. 3 is a cross-section, in a plane A-A of FIG. 4, of the selector switch.

FIG. 1 shows a detail, in longitudinal section, of a combination hammer 1. A drive mechanism can be used to move a (not illustrated) snap die (not illustrated) back and forth in a guide tube 2. The snap die strikes a (not illustrated) tool inserted in the tool receptacle 3. The tool receptacle 3 can be rotated about its longitudinal axis 4 by a hereinafter described drive. Then, the tool performs a percussion movement as well as a rotary movement. By using a selector switch 10, an operator can choose whether only the combination hammer 1 strikes the tool along (percussion mode) or whether there is also an additional rotation (drill percussion mode).

A driving wheel 6 and a clutch 7 are supported so as to be rotatable about the guide tube 2. The driving wheel 6 is driven by a primary drive, e.g., an electric motor, via a transmission and/or rod assembly. The clutch 7 is supported so as to be shiftable along the longitudinal axis 4. In a first position, the clutch 7 may be shifted into engagement with the driving wheel 6. The rotation of the driving wheel 6 is then transmitted—via the clutch 7—to the tool receptacle 3. This corresponds to the percussion and rotary mode of operation of the combination hammer 1. In a second position, the clutch 7 is retracted out of engagement with the driving wheel 6. In this second position, the combination hammer 1 strikes the tool only once.

The selector switch 10 shifts the clutch 7 between the first and second positions.

The selector switch 10 has been configured so as to be a rotary switch that comprises an eccentric 11. The eccentric 11 comes into engagement with an ear 12 of a switch element 13. The switch element 13 may be configured as a sleeve that radially encloses the guide tube 2. The switch element 13 can be slid along the guide tube 2. A ring-shaped structure 14 is provided at an end of the switch element 13 that is removed from the eccentric 11, the structure coming into engagement with a corresponding ring-shaped structure 15 of the clutch 7. In the modification shown in FIG. 1, the switch element 13 has a ring-shaped protuberance or hook that comes into engagement with a ring-shaped recess of the clutch 7.

The clutch 7 and the driving wheel 6 may be configured as a toothed wheel or as a bevel gear.

A detent 16 that is stationary, i.e., in particular not rotatable, relative to the longitudinal axis 4, may be provided. The detent 16 may be configured as a tooth, with the clutch 7 being slid onto the tooth in the second position. As a result of this, a rotation of the tool is prevented.

A spring element 17 may act on the clutch 7 with such a force that the clutch 7 is released by the driving wheel 6 in case of breakage of the switch element 13 and, optionally, is slid onto the detent 16. As shown, the spring element 17 may be implemented as the spring that pushes the clutch 7 or also as a pulling spring (not illustrated).

Figure 4:
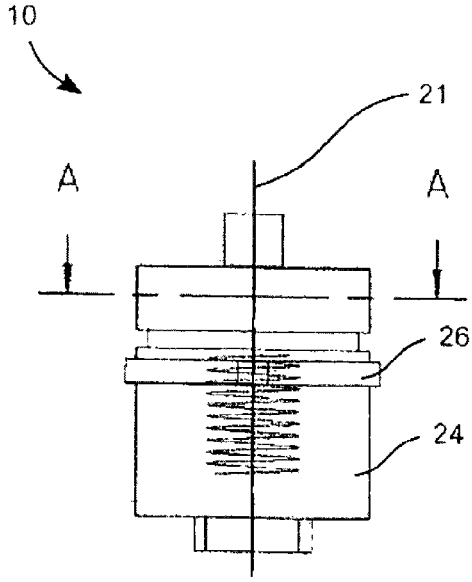
FIG. 4 is a side view of a selector switch.
Figure 5:
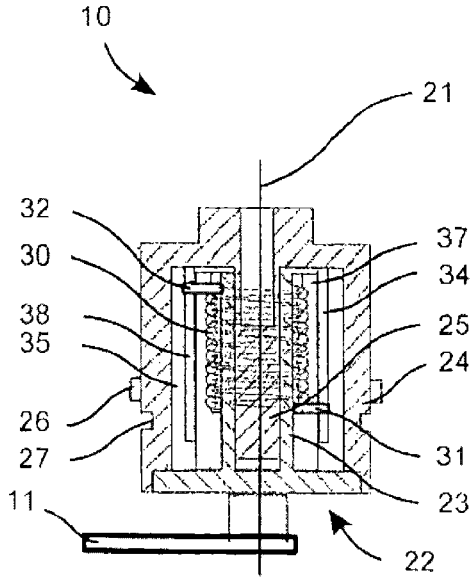
FIG. 5 is a longitudinal section, in a plane B-B of FIG. 2, of the selector switch.

One embodiment of the selector switch 10 will be explained in detail hereinafter with reference to FIGS. 2 through 5. FIG. 4 shows a side view, FIG. 2 a plan view, FIG. 3 a cross-section transversely to an axis of rotation 21 of the selector switch 10 in plane A-A of FIG. 4, and FIG. 5 shows a longitudinal section along the axis of rotation 21 in plane B-B of FIG. 3.

An actuating element 22 of the selector switch 10 comprises an eccentric 11 and a hollow hub 23. The hollow hub 23 defines an axis of rotation 21 of the selector switch 10.

A twist handle 24 of the selector switch 10 comprises a pin 25. The pin 25 is inserted in the hollow hub 23 in such a manner that the twist handle 24 can be rotated relative to the actuating element 22 and thus to the eccentric 11.

A cuff 26 may circumscribe the twist handle 24. The twist handle 24 may be provided with a peripheral groove 27 that prevents a slipping of the cuff 26. The cuff 26 may be used for fastening the twist handle 24 to a housing of the combination hammer 1. The twist handle 24 can be rotated relative to the cuff 26 or at least to the housing.

A torsion spring 30 is slipped onto the hollow hub 23. For example, the torsion spring 30 may be a spiral spring with one or more convolutions. The torsion spring 30 comprises two engagement elements 31, 32 that preferably may be angled end pieces of the torsion spring 30. The two engagement elements 31, 32 may extend in a radial direction from the torsion spring 30, as shown, for example, in FIG. 3. The two engagement elements 31, 32 define an angular range 33 within the rotary switch 10 relative to the axis of rotation 21. The height of the arrangement of the two engagement elements 31, 32, i.e., in their direction along the axis of rotation 21, may vary.

The twist handle 24 has two abutments 34, 35 that are arranged at two different angular positions relative to the axis of rotation 21, however, within the same angular range 33 defined by the engagement elements 31, 32. As illustrated, the two abutments 34, 35 may be formed by a projecting segment 36 that is arranged on the inside of the twist handle 24 and is continuous from one angular position to the other angular position. Alternatively, two lugs are provided at the respective angular positions. The arrangement of the projecting segment 36 or the lugs in a direction along the axis of rotation 21 corresponds to the height of the two engagement elements 31, 32 of the torsion spring 30. Thus, the twist handle 24 is configured in such a manner that it—during a rotation about the axis of rotation 21—comes into engagement with exactly one of the two engagement elements 31, 32. The torsion spring 30 itself is supported so as to be rotatable about the axis of rotation 21. If, on the one hand, the torsion spring 30 is not hindered in its movement due to an engagement on the other of the two engagement elements 31, 32, the torsion spring 30 is moved along by the twist handle 24. If, on the other hand, the torsion spring 30 is still held in place on the other engagement element 31, 32 by the actuating element for reasons that are yet to be explained, this results in a biasing of the torsion spring 30. Depending on the configuration, the torsion spring 30 can be expanded or compressed during the biasing action.

Like the twist handle 24, the actuating element 22 also has abutments 37, 38 that are arranged in additional angular positions. The additional angular positions may correspond to the angular positions of the abutments 34, 35 of the twist handle 24. Both the abutments 37, 38 of the actuating element 22 are arranged within the same angular range 33 as the abutments 34, 35 of the twist handle 24, with respect to the engagement elements 31, 32 of the torsion spring 30.

If the twist handle 24 is turned relative to the actuating element 22, a first abutment of the abutments 34, 35 of the twist handle 24 biases, together with a second abutment of the abutments 37, 38 of the actuating element 22, the torsion spring 30. The first abutment 34, 35 and the second abutment 37, 38 are the abutments that are the farthest away from each other within the angular range 33.

A user may actuate the selector switch 10 at any time. The selector switch 10 has not illustrated catch positions that come into engagement with the twist handle 24. The catch positions correspond to the desired modes of operation of the combination hammer 1. The clutch 7 is coupled to the actuating element 22. The clutch 7 may initially be prevented from an axial movement when the clutch 7 is twisted relative to the detent 16 or to the driving wheel 6 in such a manner that they are prevented from coming into engagement with each other. In so doing, the combination hammer 1 does not change the mode of operation in synchrony with the actuation of the selector switch. The actuating element 22—likewise impaired by the clutch 7—does not follow the rotary motion of the twist handle 24; consequently, the torsion spring 30 is biased.

By driving the combination hammer 1, the clutch 7 is continued to be rotated relative to the detent 16 or the driving wheel 6. Considering a specific angular position, a two-sided engagement is possible. The biased torsion spring 30 generates a force relative to the eccentric 11 in order to axially shift the clutch 7 into engagement.

Other embodiments of the selector switch 10 are possible.

The axis of rotation may be formed by a hollow hub of the twist handle and a pin of the actuating element. The pin is rotatably supported in the hollow hub. The torsion spring circumscribes the axis of rotation that is formed by the hollow hub and the pin.

Considering another embodiment, the torsion spring is arranged between the hollow hub and the pin.

Figure 6:
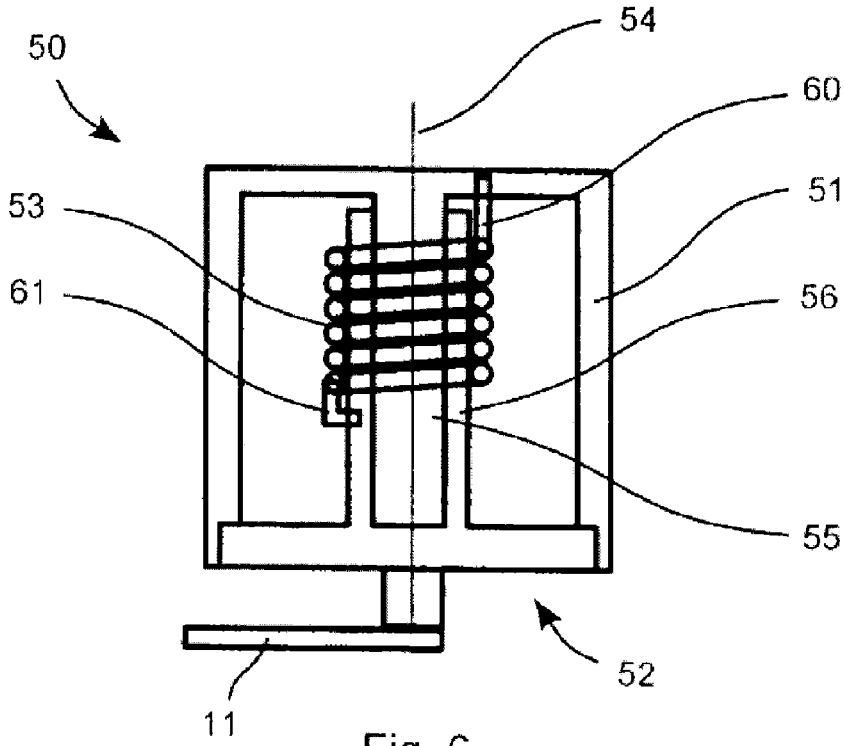
FIG. 6 is a longitudinal section through another selector switch.

Another embodiment of a selector switch 50 is shown in longitudinal section in FIG. 6. The selector switch 50 is configured as the rotary switch. The selector switch 50 comprises a twist handle 51, a rotatable actuating element 52 and a torsion spring 53 that are arranged concentrically with respect to a common axis of rotation 54. Considering the illustrated embodiment, a pin 55 of the twist handle 51 represents the axis of rotation 54. The rotatable actuating element 52 has a hollow hub 56 into which the pin 55 of the twist handle 51 is inserted.

The rotatable actuating element 52 comprises an eccentric 11 that is arranged so as to be offset relative to the axis of rotation 54.

The torsion spring 53 comprises two engagement elements 60, 61. The engagement elements 60, 61 are preferably the ends of the torsion spring 53. One of the engagement elements 60 is coupled non-positive locking or positive locking with the twist handle 51, and the other of the engagement elements 61 is coupled non-positive locking or positive locking with the rotatable actuating element 52. The torsion spring 53 is configured in such a manner that it can be twisted in both directions of rotation about the axis of rotation 54. In one embodiment, the torsion spring 53 is configured as a spiral spring with spaced apart convolutions. In addition, the torsion spring 53—in both cases—applies a force to the twist handle 51 and the rotatable actuating element 52 in such a manner that the torsion spring 53 again returns into its inoperative position.

Figure 7:
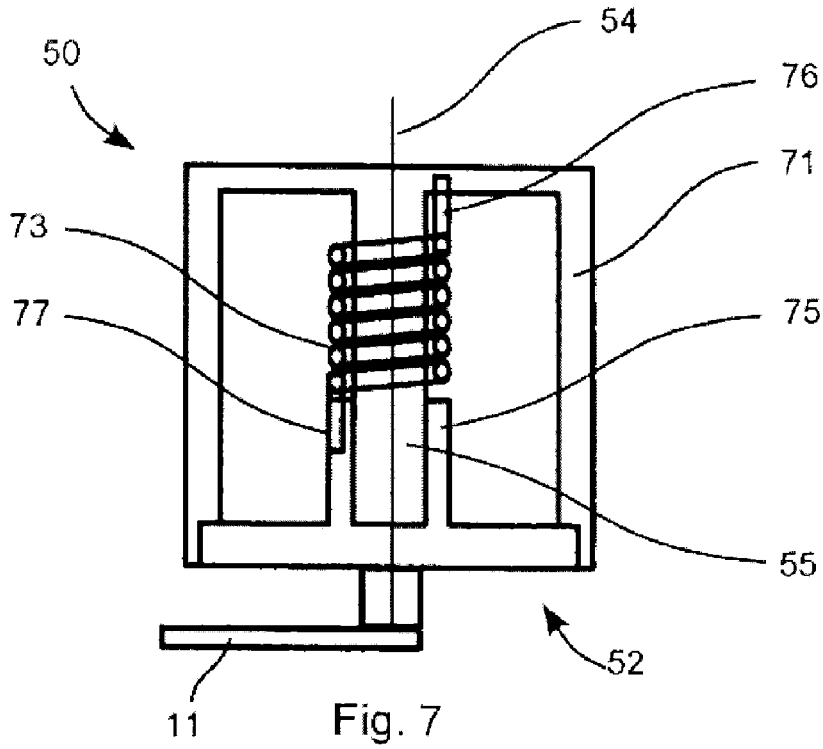
FIG. 7 is a longitudinal section through another selector switch.

FIG. 7 shows another embodiment of the selector switch. The torsion spring 73 is height-offset relative to the hollow hub 75. Again, the engagement elements 76, 77 are coupled with the twist handle 71 and the rotatable actuating element 52.

Instead of configuring the torsion spring as a separate component, the pin that is inserted in the hollow hub may be configured as a torsion spring.

The selector switch may be used so as to actuate a lever arm by means of the eccentric of the selector switch.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotary switch for shifting a switch element, comprising:

a twist handle that is rotatable into at least two positions and includes a torsion spring;

a rotatable actuating element including an eccentric that converts a rotary motion of the rotatable actuating element into a shifting motion of the switch element; and a common axis of rotation around which the twist handle, the rotatable actuating element, and the torsion spring are supported;

wherein the twist handle and the rotatable actuating element are coupled by the torsion spring such that by rotating the twist handle relative to the rotatable actuating element the torsion spring is twisted;

and further wherein:

the twist handle is rotatable relative to the rotatable actuating element in a negative direction of rotation and relative to the axis of rotation in a positive direction of rotation;

the twist handle and the rotatable actuating element, respectively, each comprise an abutment that faces in the positive direction of rotation relative to the axis of rotation and an abutment that faces in the negative direction of rotation relative to the axis of rotation; and the torsion spring comprises engagement elements that are arranged with respect to the abutments of the twist handle and the rotatable actuating element such that, as a result of relative twisting, one engagement element of the engagement elements couples with one of the abutments of the twist handle and an other of the engagement elements of the engagement elements couples with one of the abutments of the rotatable actuating element, wherein the one of the abutments of the twist handle and the one of the abutments of the actuating element are facing in opposing directions of rotation.

2. The rotary switch as claimed in claim 1, wherein the abutments of the twist handle are arranged at a first distance from the axis of rotation, wherein the abutments of the rotatable actuating element are arranged at a second distance from the axis of rotation, and wherein the first distance and the second distance are different from each other.

3. The rotary switch as claimed in claim 1, wherein one of the engagement elements only couples with the abutments of the twist handle and the other of the engagement elements only couples with the abutments of the actuating element.

4. The rotary switch as claimed in claim 1, wherein one of the engagement elements only couples with abutments that face in the positive direction of rotation and the other of the engagement elements only couples with abutments that face in the negative direction of rotation.

5. The rotary switch as claimed in claim 4, wherein the abutments of the twist handle are arranged at a first distance from the axis of rotation, wherein the abutments of the rotatable actuating element are arranged at a second distance from the axis of rotation, wherein the first distance and the second distance are different from each other, and wherein one of the engagement elements has a radial extension that extends from the axis of rotation at least from the first distance to the second distance.

6. The rotary switch as claimed in claim 5, wherein the engagement elements delimit a continuous sector of a circle relative to the axis of rotation, wherein the abutments of the twist handle and the abutments of the actuating element are arranged within the sector.

7. A tool machine having at least two different drive modes, comprising:

an axially shiftable clutch for switching between the at least two drive modes; and a selector switch configured as the rotary switch as claimed in claim 1, wherein the eccentric of the switch is coupled with the clutch.

8. The tool machine as claimed in claim 7, wherein the eccentric is coupled with the clutch by a sleeve-shaped switching rod assembly.

9. The tool machine as claimed in claim 8, further comprising a cylinder-shaped drive arrangement, wherein the sleeve-shaped switching rod assembly circumscribes the drive arrangement.

10. The tool machine as claimed in claim 8, wherein the switching rod assembly is supported so as to be rotatable about an axis of symmetry relative to the clutch, and wherein the switching rod assembly and the clutch are configured so as to come into ring-shaped engagement with each other for axially shifting the clutch by the switching rod assembly.

11. The tool machine as claimed in claim 7, further comprising a percussion drive and a rotary drive for a tool, wherein the clutch selectively couples the percussion drive and/or the rotary drive with the tool.

12. A rotary switch for shifting a switch element, comprising:

a twist handle that is rotatable into at least two positions and includes a torsion spring;

a rotatable actuating element including an eccentric that converts a rotary motion of the rotatable actuating element into a shifting motion of the switch element; and a common axis of rotation around which the twist handle, the rotatable actuating element, and the torsion spring are supported;

wherein the twist handle and the rotatable actuating element are coupled by the torsion spring such that by rotating the twist handle relative to the rotatable actuating element the torsion spring is twisted;

and wherein the rotatable actuating element includes a rotatable bearing that has a hollow hub and wherein the twist handle includes a pin that is inserted into the hollow hub so as to be rotatable.

13. The rotary switch as claimed in claim 12, wherein the twist handle and/or the rotatable actuating element are fabricated in one piece as injection-molded parts.

14. The rotary switch as claimed in claim 12, wherein:

the twist handle is rotatable relative to the rotatable actuating element in a negative direction of rotation and relative to the axis of rotation in a positive direction of rotation;

the twist handle and the rotatable actuating element, respectively, each comprise an abutment that faces in the positive direction of rotation relative to the axis of rotation and an abutment that faces in the negative direction of rotation relative to the axis of rotation; and the torsion spring comprises engagement elements that are arranged with respect to the abutments of the twist handle and the rotatable actuating element such that, as a result of relative twisting, one engagement element of the engagement elements couples with one of the abutments of the twist handle and an other of the engagement elements of the engagement elements couples with one of the abutments of the rotatable actuating element, wherein the one of the abutments of the twist handle and the one of the abutments of the actuating element are facing in opposing directions of rotation.

15. The rotary switch as claimed in claim 14, wherein the abutments of the twist handle are arranged at a first distance from the axis of rotation, wherein the abutments of the rotatable actuating element are arranged at a second distance from the axis of rotation, and wherein the first distance and the second distance are different from each other.

16. A rotary switch for shifting a switch element, comprising:

a twist handle that is rotatable into at least two positions and includes a torsion spring;

a rotatable actuating element including an eccentric that converts a rotary motion of the rotatable actuating element into a shifting motion of the switch element; and a common axis of rotation around which the twist handle, the rotatable actuating element, and the torsion spring are supported;

wherein the twist handle and the rotatable actuating element are coupled by the torsion spring such that by rotating the twist handle relative to the rotatable actuating element the torsion spring is twisted;

and wherein the twist handle includes a rotatable bearing that has a hollow hub and wherein the rotatable actuating element includes a pin that is inserted into the hollow hub so as to be rotatable.

17. The rotary switch as claimed in claim 16, wherein the twist handle and/or the rotatable actuating element are fabricated in one piece as injection-molded parts.

18. The rotary switch as claimed in claim 16, wherein:

the twist handle is rotatable relative to the rotatable actuating element in a negative direction of rotation and relative to the axis of rotation in a positive direction of rotation;

the twist handle and the rotatable actuating element, respectively, each comprise an abutment that faces in the positive direction of rotation relative to the axis of rotation and an abutment that faces in the negative direction of rotation relative to the axis of rotation; and the torsion spring comprises engagement elements that are arranged with respect to the abutments of the twist handle and the rotatable actuating element such that, as a result of relative twisting, one engagement element of the engagement elements couples with one of the abutments of the twist handle and an other of the engagement elements of the engagement elements couples with one of the abutments of the rotatable actuating element, wherein the one of the abutments of the twist handle and the one of the abutments of the actuating element are facing in opposing directions of rotation.

19. The rotary switch as claimed in claim 18, wherein the abutments of the twist handle are arranged at a first distance from the axis of rotation, wherein the abutments of the rotatable actuating element are arranged at a second distance from the axis of rotation, and wherein the first distance and the second distance are different from each other.

* * * * *